US005853942A

United States Patent [19]

Lin

[11] Patent Number: 5,853,942

[45] Date of Patent: Dec. 29, 1998

[54] TUNER PROCESSES

[75] Inventor: Pinyen Lin, Rochester, N.Y.

[73] Assignee: Xerox Corporation, Stamford, Conn.

[21] Appl. No.: 922,431

[22] Filed: Sep. 2, 1997

[51] Int. Cl.[6] ..... G03G 9/087

[52] U.S. Cl. ..... 430/137

[58] Field of Search ..... 430/109, 137

[56] References Cited

U.S. PATENT DOCUMENTS

| | | | |
|---|---|---|---|
| 4,089,917 | 5/1978 | Takiura et al. | 264/40.3 |
| 4,221,856 | 9/1980 | Lu | 430/110 |
| 4,312,933 | 1/1982 | Lu | 430/122 |
| 4,513,074 | 4/1985 | Nash et al. | 430/106.6 |
| 4,560,635 | 12/1985 | Hoffend et al. | 430/106.6 |
| 4,894,308 | 1/1990 | Mahabadi et al. | 430/137 |
| 4,973,439 | 11/1990 | Chang et al. | 264/101 |
| 4,990,293 | 2/1991 | Macosko et al. | 264/40.1 |
| 5,229,242 | 7/1993 | Mahabadi et al. | 430/106.6 |
| 5,376,494 | 12/1994 | Mahabadi et al. | 430/137 |
| 5,716,752 | 2/1998 | Ott et al. | 430/137 |

*Primary Examiner*—John Goodrow
*Attorney, Agent, or Firm*—E. O. Palazzo

[57] ABSTRACT

A process for the preparation of toner which comprises mixing with a first toner resin a second resin incompatible with said first resin thereof, and thereafter adding colorant, wax, compatibilizer, and optional charge additive.

27 Claims, No Drawings

TUNER PROCESSES

BACKGROUND OF THE INVENTION

The present invention is generally directed to toner compositions, and more specifically, to toners with a mixture of resins. With the present invention in embodiments thereof, there is provided a process for generating toners with excellent jetting rates and wherein the process comprises incorporating an incompatible polymer, or polymers into a toner containing a first resin. More specifically, the present invention relates to toners and processes for the preparation of toners wherein there is incorporated into the toner a first resin, and a second incompatible resin, that is for example a second resin that will form with the first resin two separate phases, a continuous phase and an isolated domain, and wherein the first resin is comprised, for example, of styrene acrylates, styrene methacrylates, styrene butadienes, polyesters, and the like, and wherein the second incompatible resin is one that is immiscible with the first toner resin, and which second resin includes, for example, preferably polystyrene like a polystyrene with an $M_n$, of about 1,500 and a Tg of about 55° C. The second incompatible resin is present in various effective amounts of, for example, from about 0.5 to about 15, from about 1 to about 10, or from about 7 to about 10 weight percent, and wherein the percent total of all components is about 100 percent. It is believed that the second incompatible resin weakens the overall toner mechanical strength and thus enables high toner jetting rates, for example an about 20 to an about 40 percent increase in toner jetting rates as compared to similar toners without the second compatible polymer, or resin. The resulting toner compositions can be selected for electrophotographic, especially xerographic, imaging and printing systems, and for digital imaging processes.

PRIOR ART

Certain toner compositions and processes thereof are known. For example, toners with thermoplastic resin, pigment, charge additives, and surface additives, and which toners can be prepared by melt mixing are illustrated in U.S. Pat. Nos.3,893,935; 4,221,856; 4,312,933, and 4,560,635. Toners with polyester resins are illustrated in U.S. Pat. No. 3,590,000, and toners with reactive extruded polyesters are illustrated in U.S. Pat. No. 5,376,494. In this patent, it is indicated that there is provided toners with low melting temperatures, and wherein the lowest temperature at which the toner adheres to the support medium is referred to as the Cold Offset Temperature (COT), and the maximum temperature at which the toner does not adhere to the fuser roll is referred to as the Hot Offset Temperature (HOT). When the fuser temperature exceeds HOT, some of the molten toner adheres to the fuser roll during fixing and is transferred to subsequent substrates containing developed images resulting, for example, in blurred images. This undesirable phenomenon is known as offsetting. Between the COT and HOT of the toner is the Minimum Fix Temperature (MFT) which is the minimum temperature at which acceptable adhesion of the toner to the support medium occurs, as determined by, for example, the known crease test. The difference between MFT and HOT is referred to as the Fusing Latitude.

Toners containing vinyl type binder resins, such as styrene acrylic resins, may possess vinyl offset. Vinyl offset occurs when a sheet of paper or transparency with a fixed toner image comes in contact for a period of time with a polyvinyl chloride (PVC) surface containing a plasticizer used in making the vinyl material flexible, such as for example in vinyl binder covers, and the fixed image adheres to the PVC surface. The aforementioned reactive extruded polyester toners possess a low jetting rate primarily in view of the presence of a compatibilizer. These and other problems and disadvantages are avoided or minimized with the processes and toners of the present invention.

To prevent fuser roll offsetting and to increase fuser latitude of toners, various modifications have been made to toner compositions. For example, waxes, such as low molecular weight polyethylene, polypropylene, have been added to toners to increase the release properties, as disclosed in U.S. Pat. No. 4,513,074, the disclosure of which is totally incorporated herein by reference. However, to prevent offset sufficiently, considerable amounts of such materials may be required in some instances, resulting in detrimental effects, such as the tendency to cause toner agglomeration, undesirable toner free flow properties and the destabilization of the toner charging properties.

Modification of the toner binder resin by, for example, branching, crosslinking, and the like when using conventional polymerization reactions may also improve offset resistance. In U.S. Pat. No. 3,681,106, a polyester resin offset resistance was improved by nonlinearly modifying the polymer backbone by mixing a trivalent or more polyol or polyacid with the monomer to generate branching during polycondensation. However, an increase in degree of branching may result in an elevation of the minimum fix temperature. Thus, any initial advantage of low temperature fix may be diminished. Another method of improving offset resistance is to utilize a crosslinked resin in the binder resin. For example, U.S. Pat. No. 3,941,898 discloses a toner in which a crosslinked vinyl type polymer is used as the binder resin. Similar disclosures for vinyl type resins are illustrated in U.S. Pat. No. Re. 31,072 (a reissue of U.S. Pat. No. 3,938,992); U.S. Pat. Nos. 4,556,624; 4,604,338 and 4,824,750. Crosslinked polyester binder resins prepared by conventional polycondensation reactions have been generated for improving offset resistance, such as for example the resins and processes of U.S. Pat. No. 3,681,106. Increasing crosslinking as obtained in such conventional polycondensation reactions may cause the minimum fix temperature to increase. When crosslinking is accomplished during polycondensation using tri- or polyfunctional monomers as crosslinking agents with the polycondensation monomers, the net effect is that apart from obtaining highly crosslinked high molecular weight gel particles, which are not soluble in substantially any solvent, the molecular weight distribution of the soluble part widens due to the formation of sol or crosslinked polymer with a very low degree of crosslinking, which is soluble in some solvents. These intermediate high molecular weight species may result in an increase in the melt viscosity of the resin at low and high temperatures, which can cause the minimum fix temperature to increase. Furthermore, gel particles formed in the polycondensation reaction, which is accomplished using conventional polycondensations in a reactor with low shear mixing, can grow rapidly with a corresponding increase in the amount, or degree of crosslinking.

U.S. Pat. No. 4,894,308 and U.S. Pat. No. 4,973,439, for example, disclose extrusion processes for preparing electrophotographic toner compositions in which pigment and charge control additive can be dispersed into a binder resin in the extruder.

The processes disclosed in U.S. Pat. Nos. 3,876,736; 4,089,917 and 4,990,293 are not believed to be reactive extrusion processes, primarily because the crosslinking occurs in a die or a mold, and not in an extruder, and the crosslinking takes place at low or zero shear. These processes are for the production of producing engineering plastics, such as thermoset materials, which cannot be remelted once molded, and thus are not suitable for toner application.

SUMMARY OF THE INVENTION

The present invention provides a toner which can be sufficiently fixed at low temperatures, for example about below 200° C., and preferably about below 160° C., and more specifically, from about 135° C. to about 160° C., by hot roll fixing. Thus, less heat or other sources of energy are needed for fixing as compared to toners without a second incompatible resin, and therefore, less power is consumed during operation of a copier or printer. The undesirable paper curl phenomenon may also be reduced, and a higher speed of copying and printing may be enabled. Also, toner prepared with a mixture of resins, one of which is an incompatible resin, possesses excellent offset resistance, wide fusing latitude and excellent Theological properties, is inexpensive and safe, and evidences minimized or substantially no vinyl offset.

Embodiments of the present invention include a process for the preparation of a toner which comprises mixing with a first toner resin a second resin incompatible with said first resin thereof, and thereafter adding colorant, wax, compatibilizer, and optional charge additive; a process wherein the toner jetting rate is improved by from about 26 percent to about 44 percent as compared to the same, or similar toner wherein said incompatible resin is absent, and wherein said incompatible resin and said first resin form two separate phases; a process wherein said incompatible resin is a linear or branched polymer forming small domains within said toner, and which domains possess an average volume domain diameter of from about 0.05 to about 2 microns, and preferably from about 0.1 to about 1 micron, as determined, for example, by a Coulter Counter, said incompatible polymer domains being substantially uniformly distributed throughout said first and said second toner resins; wherein said incompatible resin is a styrene copolymer, a methacrylate copolymer, an olefinic homopolymer, or an olefinic copolymer; a process wherein said incompatible resin is selected in an amount of from about 0.5 to about 15 weight percent based on the total amount of said first resin and said second incompatible resin; a process wherein said incompatible resin is selected in an amount of from about 2 to about 10 weight percent based on the total amount of said first resin and said second incompatible resin; a process wherein said incompatible resin is selected in an amount of from about 2.5, 4, 7, or 10 weight percent based on the total amount of said first resin and said second incompatible resin; a process wherein the wax is of a low molecular weight of from about an average $M_w$, or $M_n$ of from about 1,000 to about 20,000; a process wherein is the wax is propylene, polyethylene, or mixtures thereto; a process wherein the colorant is carbon black; a process wherein the compatibilizer is a graft copolymer like Kraton, and more specifically, an ethylene-glycidyl methacrylate copolymer; a process wherein the first resin is present in an amount of from about 75 to about 85 weight percent, the incompatible second resin is present in an amount of from about 2 to about 10 weight percent, the colorant is present in an amount of from about 5 to about 10 weight percent, the wax is present in an amount of from about 2 to about 7 weight percent, and the compatibilizer is present in an amount of from about 2 to about 7 weight percent; a process wherein the first resin comprises linear portions and crosslinked portions, and said crosslinked portions consist essentially of high density crosslinked microgel particles; a process wherein said microgel particles are present in an amount from about 0.001 to about 50 percent by weight of said first toner resin; a process wherein said microgel particles are present in an amount of from 0.1 to about 40 percent by weight of said first toner resin; a process wherein said microgel particles have no more than a single bridging molecule between crosslinked chains; a process wherein said linear portions have a number average molecular weight ($M_n$), as measured by gel permeation chromatography, in the range of from about 1,000 to about 20,000; a process wherein said toner comprises at least one charge additive selected from the group consisting of alkyl pyridinium halides and distearyl dimethyl ammonium methyl sulfate; and a process for the preparation of toner which comprises mixing an incompatible first resin with a second resin, and thereafter adding colorant, wax, and compatibilizer.

The primary, or first toner resin of the present invention comprises, for example, a reactive extruded polyester with crosslinked portions and linear portions, reference the toner resins of U.S. Pat. No. 5,376,494, the disclosure of which is totally incorporated herein by reference. The crosslinked portions comprise very high molecular weight gel particles having an average diameter less than about 0.1 micron and with high density crosslinking insoluble in substantially any solvent, including tetrahydrofuran, toluene and the like. The linear portion comprises low molecular weight resin soluble in various solvents, such as for example tetrahydrofuran, toluene and the like, and the high molecular weight highly crosslinked gel particles are substantially uniformly distributed in the linear portions. Substantially no portion of the resin comprises sol or low density crosslinked polymer, such as that which would be obtained in conventional crosslinking processes, such as polycondensation, bulk, solution, suspension, or emulsion, and dispersion polymerization processes. The first toner resin may be prepared by a reactive melt mixing process. In this process, a reactive base resin, preferably an unsaturated polyester resin, is partially crosslinked at high temperature and under high shear, preferably with chemical initiators.

Of importance with respect to the present invention is the addition of an incompatible polymer, or resin, such as polystyrene, to the toner formulation containing a first resin, such as a reactive extruded polyester resin, thereby enabling improved toner jetting rates.

DETAILED DESCRIPTION

The present invention provides a low fixing temperature toner, wherein the low fixing temperature is, for example, from about 135° C. to about 160° C., and which toner contains a first resin of a crosslinked resin comprised of crosslinked and linear portions, the crosslinked portions consisting essentially of microgel particles with an average volume particle diameter up to 0.1 micron, and preferably about 0.005 to about 0.1 micron, the microgel particles being substantially uniformly distributed throughout the linear portions, and wherein there is added to the toner an incompatible polymer, such as polystyrene, in effective amounts, for example small amounts of from about 0.5 to about 15, and preferably from about 2 to about 10 weight percent. The incompatible polymer can form small domains inside the toner particles, and which domains are of a size in average volume domain diameter of from about 0.05 to about 2 microns, and preferably from about 0.1 to about 1 micron, the incompatible polymer domain being substantially uniformly distributed throughout the first toner resin. There is not believed to be a chemical reaction in the interface between the incompatible resin domain and the primary toner resin. The onset glass transition temperature of the incompatible resin is in the range of, for example, from about 50° C. to about 70° C., and preferably from about 51° C. to about 65° C. The molecular weight of the incompatible resin is preferably below the critical entanglement molecular weight.

The toner jetting rate can be illustrated as follows:

$$\text{Jetting rate}=K^*(1+\%\text{ second incompatible resin in toner})$$

where K is a constant ranging from 1 to 8 and is a function of the polymer choice and the molecular weight. Furthermore, the fusing performance of toner is not substantially adversely affected by the addition of the second incompatible resin. In embodiments, the jetting rates can be from about 20 to about 60 pounds/hour.

Examples of incompatible second resin particles that can, for example, be added to the first and primary toner resin include styrene copolymers such as polystyrene, styrene-butadiene copolymers, styrene-maleic acid copolymers, styrene-isoprene copolymers, styrene-(meth)acrylate copolymers; methacrylate copolymers such as polymethyl methacrylate, poly-2-ethylhexyl methacrylate, polybutyl methacrylate, polyhexyl methacrylate, and lauryl polymethacrylate; polyvinyl acetate; olefinic homo- or copolymers such as polyethylene and polypropylene; and polyimides. The total percentage of the incompatible resin, or mixtures thereof is, for example, from about 0.5 to about 15, and preferably from about 2 to about 10 weight percent.

The partially crosslinked unsaturated first resin, such as unsaturated polyester, can be prepared by crosslinking a linear unsaturated resin (base resin), such as linear unsaturated polyester resin, preferably with a chemical initiator in a melt mixing device, such as, for example, an extruder at high temperature (e.g., above the melting temperature of the resin and preferably up to about 150° C. above that melting temperature) and under high shear. In preferred embodiments, the base resin has a degree of unsaturation of about 0.1 to about 30 mole percent, preferably about 5 to about 25 mole percent. The shear levels should be sufficient to inhibit microgel growth above about 0.1 micron average particle diameter and to ensure substantially uniform distribution of the microgel particles These shear levels are readily available in melt mixing devices such as extruders. This toner resin possesses a weight fraction of the microgel (gel content) in the resin mixture in the range of typically from about 0.001 to about 50 weight percent, preferably about 0.1 to about 40, or 10 to 19 weight percent. The linear portion is comprised of base resin, preferably unsaturated polyester, in the range of from about 50 to about 99.999 percent by weight of said toner resin, and preferably in the range of from about 60 to about 99.9, or 81 to 90 percent by weight of said toner resin. The linear portion of the resin preferably consists essentially of low molecular weight reactive base resin, which did not crosslink during the crosslinking reaction, preferably unsaturated polyester resin. The number average molecular weight ($M_n$) of the linear portion as measured by gel permeation chromatography (GPC) is in the range of typically from about 1,000 to about 20,000, and preferably from about 2,000 to about 5,000. The weight average molecular weight ($M_w$) of the linear portion is in the range of typically from about 2,000 to about 40,000, and preferably from about 4,000 to about 15,000. The molecular weight distribution ($M_w/M_n$) of the linear portion is in the range of typically from about 1.5 to about 6, and preferably from about 2 to about 4. The onset glass transition temperature (Tg) of the linear portion as measured by differential scanning calorimetry (DSC) is in the range of from about 50° C. to about 70° C., and preferably from about 51° C. to about 60° C. Melt viscosity of the linear portion of preferred embodiments as measured with a mechanical spectrometer at 10 radians per second is from about 5,000 to about 200,000 poise, and preferably from about 20,000 to about 100,000 poise, at 100° C. and drops sharply with increasing temperature to from about 100 to about 5000 poise, and preferably from about 400 to about 2,000 poise, as the temperature rises from 100° C. to 130° C.

The toner resin contains a mixture of crosslinked resin microgel particles and a linear portion as illustrated herein. In embodiments, toner polyester reactive extruded possesses an onset Tg in the range of typically from about 50° C. to about 70° C., and preferably from about 51° C. to about 60° C., and a melt viscosity as measured with a mechanical spectrometer at 10 radians per second is from about 5,000 to about 200,000 poise, and preferably from about 20,000 to about 100,000 poise at 100° C. and from about 10 to about 20,000 poise at 160° C.

The weight fraction of the microgel (gel content) in the reactive extruded polyester resin may be determined as follows:

$$\text{Gel Content}=\frac{\text{Total Sample Weight}_\text{Weight of Soluble Polymer}}{\text{Total Sample Weight}}\times 100\%$$

The gel content may be calculated by measuring the relative amounts of linear, soluble polymer and the nonlinear, crosslinked polymer utilizing the following procedure: (1) the sample of the crosslinked resin to be analyzed, in an amount between 145 and 235 milligrams, is weighed directly into a glass centrifuge tube; (2) 45 milliliters of toluene are added and the sample is put on a shaker for at least 3 hours, preferably overnight; (3) the sample is then centrifuged at about 2,500 rpm for 30 minutes and then a 5 milliliter aliquot is carefully removed and put into a preweighed aluminum dish; (4) the toluene is allowed to air evaporate for about 2 hours, and then the sample is further dried in a convection oven at 60° C. for about 6 hours or to constant weight; (5) the sample remaining, times nine, gives the amount of soluble polymer. Thus, utilizing this quantity in the above Equation, the gel content can be easily calculated.

Linear unsaturated polyesters selected as the base resin include low molecular weight condensation polymers which may be formed by the step-wise reactions between both saturated and unsaturated diacids (or anhydrides) and dihydric alcohols (glycols or diols). The resulting unsaturated polyesters are reactive (e.g., crosslinkable) from two perspectives: (i) unsaturation sites (double bonds) along the polyester chain, and (ii) functional groups such as carboxyl, hydroxyl, etc. groups amenable to acid-base reactions. Typical unsaturated polyester base resins useful for this invention are prepared by melt polycondensation or other polymerization processes using diacids and/or anhydrides and diols. Suitable diacids and dianhydrides include but are not limited to saturated diacids and/or anhydrides, such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, and mixtures thereof; and unsaturated diacids and/or anhydrides, such as for example maleic acid, fumaric acid, chloromaleic acid, methacrylic acid, acrylic acid, itaconic acid, citraconic acid, mesaconic acid, maleic anhydride, and the like, and mixtures thereof. Suitable diols include but are not limited to, for example, propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like, and mixtures thereof, soluble in solvents such as, for example, tetrahydrofuran, toluene, and the like.

Preferred unsaturated polyester base resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. A particularly preferred polyester is poly(propoxylated bisphenol A fumarate).

Chemical initiators, such as, for example, organic peroxides or azo compounds, are preferably selected for the preparation of the first crosslinked toner resin. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy) hexane, oo-t-butyl o-(2-ethyl hexyl) mono peroxy carbonate, and oo-t-amyl o-(2-ethyl hexyl) mono peroxy carbonate, alkyl peroxides such as, for example, dicumyl peroxide, 2,5-dimethyl 2,5-di(t-butyl peroxy) hexane, t-butyl cumyl peroxide, bis(t-butyl peroxy) diisopropyl benzene, di-t-butyl peroxide and 2,5-dimethyl 2,5-di(t-butyl peroxy) hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy) valerate, 1,1-di(t-butyl peroxy) 3,3,5-trimethyl cyclohexane, 1,1-di(t-butyl peroxy) cyclohexane, 1,1-di(t-amyl peroxy) cyclohexane, 2,2-di(t-butyl peroxy) butane, ethyl 3,3-di(t-butyl peroxy) butyrate and ethyl 3,3-di(t-amyl peroxy) butyrate. Suitable azo compounds include azobis-isobutyronitrile, 2,2'-azobis (isobutyronitrile), 2,2'-azobis(2,4-dimethyl valeronitrile), 2,2'-azobis(methyl butyronitrile), 1,1'-azobis(cyano cyclohexane) and other similar known compounds.

In a process embodiment, the reactive extruded polyester primary resin, present in amounts of, for example, from about 85 to about 98 weight percent based on the weight percent of the total of this polyester and the incompatible polymer is prepared by (1) feeding base resin and initiator to an extruder; (2) melting the base resin, thereby forming a polymer melt; (3) mixing the molten base resin and initiator at low temperature to enable good dispersion of the initiator in the base resin before the onset of crosslinking; (4) initiating crosslinking of the base resin with the initiator by raising the melt temperature and controlling it along the extruder channel; (5) retaining the polymer melt in the extruder for a sufficient residence time at a given temperature such that the required amount of crosslinking is achieved; (6) providing sufficiently high shear during the crosslinking reaction thereby keeping the gel particles formed during crosslinking small in size and well distributed in the polymer melt; (7) optionally devolatilizing the melt to remove any effluent volatiles; and (8) pumping the crosslinked first resin melt through a die to a pelletizer.

Various suitable colorants can be selected including suitable colored pigments, dyes, and mixtures thereof including carbon black, such as REGAL 330® carbon black (Cabot), Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, LITHOL SCARLET™, Hostaperm Red, Fanal Pink, Hostaperm Pink, Lithol Red, Rhodamine Lake B, Brilliant Carmine, HELIOGEN BLUE™, Hostaperm Blue, Neon Blue, PV FAST BLUE™, Cinquassi Green, Hostaperm Green, titanium dioxide, cobalt, nickel, iron powder, Sicopur 4068 FF, and iron oxides, such as MAPICO BLACK® (Columbia), NP608 and NP604 (Northern Pigment), Bayferrox 8610 (Bayer), MO8699 (Mobay), TMB-100 (Magnox), mixtures thereof and the like. Colorant includes dye, pigment, mixtures thereof, mixtures of pigments, mixtures of dyes, and the like.

The colorant, preferably carbon black, cyan, magenta and/or yellow colorant, is present in the toner in an amount sufficient to impart the desired color to the toner. In general, the pigment or dye is employed in an amount ranging from about 2 to about 60 percent by weight, and preferably from about 2 to about 7 percent by weight for color, other than black toner, and about 5 to about 60, or from about 10 to about 20 percent by weight for black toner.

Various known suitable effective positive or negative charge enhancing additives can be selected for incorporation into the toner compositions of the present invention, preferably in an amount of about 0.1 to about 10, more preferably about 1 to about 3 percent by weight. Examples include quaternary ammonium compounds inclusive of alkyl pyridinium halides; alkyl pyridinium compounds, reference U.S. Pat. 4,298,672, the disclosure of which is totally incorporated hereby by reference; organic sulfate and sulfonate compositions, U.S. Pat. 4,338,390, the disclosure of which is totally incorporated hereby by reference; cetyl pyridinium tetrafluoroborates; distearyl dimethyl ammonium methyl sulfate; aluminum salts, such as BONTRON E84™ or E88™ (Hodogaya Chemical); and the like.

Additionally, other internal and/or external additives may be added in known amounts for their known functions, such as compatibilizers. Examples of compatibilizers, which are preferably present in the toner include ethylene-glycidyl methacrylate copolymers, such as AX8840 available from Elf AtoChem. Examples of compatibilizers also include block or graft copolymers of the formula A-(block)-B, A-b-B-b-A or A-(graft)-B with the polymeric segments A and B each being compatible with a different polymer thereby permitting the compatibilizer to serve, for example, as a macromolecular surfactant. Examples of compatibilizers include styrene-ethylene/propylene block copolymers, such as the KRATON® copolymers, available from Shell Chemical Company, and STEREON® copolymers, available from Firestone Tire and Rubber Company. For example, KRATON G1701X®, a block copolymer of styrene-ethylene/propylene, KRATON G1726X®, a block copolymer of styrene-ethylene/butylene-styrene, KRATON G1652®, a block copolymer of styrene-ethylenelbutylene-styrene, STEREON 730A®, a block copolymer of styrene and butadiene, and the like are suitable for improving the wax dispersion in styrenic resins. With KRATON G1701X® the A segment could be the styrene block and the B segment could be an ethylene/propylene block, reference U.S. Pat. No. 5,229,242, the disclosure of which is totally incorporated herein by reference. In the U.S. Pat. No. 5,229,242 invention, there are illustrated toners wherein the compatibilizer is of the formula A-b-B, A-b-B or A-g-B, wherein A-b-B is a block copolymer of 2 segments, A and B, A-b-B-b-A is a block copolymer of 3-segments, A, B and A, and A-g-B is a graft copolymer of segments A and B, wherein the polymeric segment A is identical or compatible to one of the components present in the toner composition, that is, the toner resin, whereas the polymeric segment B is identical or compatible with the other polymer component in the toner composition, that is for example, the wax. Thus, in embodiments of U.S. Pat. No. 5,229,242 the aforementioned compatibilizer can be comprised of rigid units, such as styrene, with the polymeric segment B being comprised of flexible, rubber-like units such as ethylene/propylene. The molecular weight of polymeric segment A can be from about 3,000 to about 100,000, and the molecular weight of polymeric segment B can be from about 5,000 to about 200,000. The compatibilizer is present in various effective amounts, such as, for example, from about 0.5 to about 9 percent, and preferably from about 1 to about 5 weight percent in embodiments of the present invention.

The resulting toner particles optionally can be formulated into a developer composition by mixing with carrier particles. Illustrative examples of carrier particles that can be selected for mixing with the toner composition prepared in accordance with the present invention include those particles that are capable of triboelectrically obtaining a charge of opposite polarity to that of the toner particles. Accordingly, in one embodiment the carrier particles may be selected so as to be of a negative polarity in order that the toner particles, which are positively charged, will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluorethylenes, other known coatings and the like.

The diameter of the carrier particles is generally from about 50 microns to about 1,000 microns, preferably about 200 microns, thus allowing these particles to possess sufficient density and inertia to avoid adherence to the electrostatic images during the development process. The carrier particles can be mixed with the toner particles in various suitable combinations. However, best results are obtained when about 1 part carrier to about 10 parts to about 200 parts by weight of toner are mixed.

The toners and developers can be used in known electrostatographic imaging methods, although the fusing energy requirements of some of those methods can be reduced in view of the advantageous fusing properties of the toner of the invention as discussed herein. Thus, for example, the toners or developers can be charged, e.g., triboelectrically, and applied to an opposite charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll at a temperature lower than 200° C., preferably lower than 160° C., more preferably lower than 140° C., and more preferably about 110° C.

The invention will further be illustrated in the following nonlimiting Examples, it being understood that these examples are intended to be illustrative only and that the invention is not intended to be limited to the materials, conditions, process parameters and the like recited herein. Parts and percentages are by weight unless otherwise indicated.

EXAMPLE I

A crosslinked unsaturated polyester resin is prepared by the reactive extrusion process by melt mixing 99.3 parts of a linear bisphenol A fumarate polyester base resin with an $M_n$ of about 4,000, an $M_w$ of about 10,300, an $M_w/M_n$ of about 2.58 as measured by GPC, onset Tg of about 55° C. as measured by DSC, and melt viscosity of about 29,000 poise at 100° C. and about 750 poise at 130° C. as measured at 10 radians per second, and 0.7 parts benzoyl peroxide initiator as outlined in the following procedure.

The unsaturated polyester resin and benzoyl peroxide initiator are blended in a rotary tumble blender for 30 minutes. The resulting dry mixture is then fed into a Werner & Pfleiderer ZSK-30 twin screw extruder with a screw diameter of 30.7 millimeters and a length-to-diameter (L/D) ratio of 37.2, at 10 pounds per hour using a loss-in-weight feeder. The crosslinking is accomplished in the extruder using the following process conditions: barrel temperature profile of 70°/140°/140°/140°/140°/140°/140° C., die head temperature of 140° C., screw speed of 100 revolutions per minute and average residence time of about three minutes. The extrudate melt, upon exiting from the strand die, is cooled in a water bath and pelletized. The product, which is crosslinked polyester, has an onset Tg of about 54° C. as measured by DSC, melt viscosity of about 40,000 poise at 100° C. and about 150 poise at 160° C. as measured at 10 radians per second, a gel content of about 0.7 weight percent and a mean microgel particle size of about 0.1 micron as determined by transmission electron microscopy.

The linear and crosslinked portions of the product are separated by dissolving the product in tetrahydrofuran and filtering off the microgel. The dissolved portion is reclaimed by evaporating the tetrahydrofuran. This linear part of the resin, when characterized by GPC, is found to have $M_n$ of about 3,900, $M_w$ of about 10,100, $M_w/M_n$ of about 2.59, and onset Tg of 55° C. which is substantially the same as the original noncrosslinked resin, which indicates that it contains no sol.

Thereafter, a toner is formulated by melt mixing 84.5 percent by weight of the aforementioned extruded first resin with 2.5 weight percent of the incompatible second resin of polystyrene, D125 obtained from Hercules-Sanyo Inc., 5 percent by weight of REGAL 330® carbon black from Cabot Inc., 4 weight percent of propylene wax, VISCOL 660P obtained from Sanyo Chemicals, and 4 weight percent of the compatibilizer AX8840, an ethylene-glycidyl methacrylate copolymer obtained from Elf AtoChem in a Werner & Pfleiderer ZSK-28 twin screw extruder at barrel set temperatures ranging from 90° C. to 120° C. at a throughput rate of 5 to 10 pounds/hour. The strands of melt mixed product exiting from the extruder are cooled by immersing them in a water bath maintained at room temperature, about 25° C. Subsequent to air drying, the resulting toner is pulverized and classified to form a toner with an average particle diameter of about 9.1 microns and a geometric size distribution (GSD) of about 1.32 measured by a Coulter Counter. Jetting rates are calculated from collection yields, and found to be 24 pounds/hour.

Subsequently, there is prepared a developer composition by admixing the aforementioned formulated toner composition mechanically blended at 72° F. at a 3 percent toner concentration, that is 3.0 parts by weight of toner per 100 parts by weight of carrier comprised of a steel core, 90 microns diameter, with a coating, 0.8 weight percent thereover of a polyvinylidine fluoride, 40 weight percent, and polymethyl methacrylate, 60 weight percent. Thereafter, the formulated developer composition is incorporated into an electrostatographic imaging device with a toner transporting means, a toner metering charging means, and a development zone as illustrated in U.S. Pat. No. 4,394,429, the disclosure of which is totally incorporated herein by reference. Fusing conditions for the imaging device were varied so as to determine the minimum fix temperature behavior from the developed image. The paper is released easily after the toner image is fused and no scratching is caused by stripper fingers present in the imaging device on developed solid areas as determined by visual examination. The Hot Offset Temperature evaluated as the temperature that the toner image starts to offset onto the fuser roll. Fusing evaluation by a standard image crease test is performed, and the minimum fix temperature of the toner is found to be F=−34° C. compared to an F=−33° C. for the same toner without polystyrene. A more negative value of "F" represents a lower fusing temperature.

EXAMPLE II

A toner is formulated by melt mixing 83 percent by weight of the aforementioned extruded resin of Example I with 4 weight percent of polystyrene, D125 obtained from Hercules-Sanyo Inc., 5 percent by weight of REGAL 330® carbon black from Cabot Inc., 4 weight percent of propylene wax, VISCOL 660P obtained from Sanyo Chemicals, and 4 weight percent of the compatibilizer AX8840, an ethylene-glycidyl methacrylate copolymer obtained from Elf AtoChem in a Werner & Pfleiderer ZSK-28 twin screw extruder at the same melt mixing conditions as Example I. Subsequent to air drying, the resulting toner is pulverized and classified to form a toner with an average particle diameter of about 9 microns and a geometric size distribution (GSD) of about 1.3 measured by a Coulter Counter. Jetting rates are calculated from collection yields, and found to be 24 pounds/hour.

Subsequently, there is prepared a developer composition by admixing the aforementioned formulated toner composition mechanically blended at the same conditions of those in Example I and with the same carrier. Thereafter, fusing evaluation by a standard image crease test is performed, and the minimum fix temperature of the toner is found to be F=33° C.

F is the difference of minimum fix temperature of the toner and that of a Xerox Corporation 1090 machine toner; a more negative value of F represents a lower fusing temperature F=−33° C.

EXAMPLE III

A toner is formulated by melt mixing 80 percent by weight of the aforementioned extruded resin in Example I with 7 weight percent of polystyrene, D125 obtained from Hercules-Sanyo Inc., 5 percent by weight of REGAL 330® carbon black from Cabot Inc., 4 weight percent of propylene wax, VISCOL 660P obtained from Sanyo Chemicals, and 4 weight percent of the compatibilizer AX8840, an ethylene-glycidyl methacrylate copolymer obtained from Elf AtoChem in a Werner & Pfleiderer ZSK-28 twin screw extruder at the same melt mixing conditions as Example I. Subsequent to air drying, the resulting toner is pulverized and classified to form a toner with an average particle diameter of about 9.2 microns and a geometric size distribution (GSD) of about 1.34 measured by a Coulter Counter. Jetting rates are calculated from collection yields, and found to be 30 pounds/hour.

Subsequently, there is prepared a developer composition by admixing the aforementioned formulated toner composition mechanically blended at the same conditions as those in Example I and with the carrier of Example I. Thereafter, fusing evaluation by a standard image crease test is performed, and the minimum fix temperature of the resulting toner is found to be F=−33° C.

EXAMPLE IV

A toner is formulated by melt mixing 77 percent by weight of the aforementioned extruded resin of Example I with 10 weight percent of polystyrene, D125 obtained from Hercules-Sanyo Inc., 5 percent by weight of REGAL 330® carbon black from Cabot Inc., 4 weight percent of propylene wax, VISCOL 660P obtained from Sanyo Chemicals, and 4 weight percent of the compatibilizer AX8840, an ethylene-glycidyl methacrylate copolymer obtained from Elf AtoChem in a Werner & Pfleiderer ZSK-28 twin screw extruder at the same melt mixing conditions as Example I. Subsequent to air drying, the resulting toner is pulverized and classified to form a toner with an average particle diameter of about 8.9 microns and a geometric size distribution (GSD) of about 1.35 measured by a Coulter Counter. Jetting rates are calculated from collection yields, and found to be 28 pounds/hour.

Subsequently, there is prepared a developer composition by admixing the aforementioned formulated toner composition mechanically blended at the same conditions as those in Example I and with the carrier of Example I. Thereafter, fusing evaluation by a standard image crease test is performed, and the minimum fix temperature of the resulting toner is found to be F=−34° C. Thus, there is an increase in the toner jetting rate without adversely effecting fusing.

EXAMPLE V

A toner is formulated by melt mixing 92.5 percent by weight of the aforementioned extruded resin in Example I with 2.5 weight percent of polystyrene, D125 obtained from Hercules-Sanyo Inc., 5 percent by weight of REGAL 330® carbon black from Cabot Inc. in a Werner & Pfleiderer ZSK-28 twin screw extruder at the same melt mixing conditions as Example I. Subsequent to air drying, the resulting toner is pulverized and classified to form a toner with an average particle diameter of about 9.2 microns and a geometric size distribution (GSD) of about 1.3 measured by a Coulter Counter. Jetting rates are calculated from collection yields, and found to be 44 pounds/hour.

Subsequently, there is prepared a developer composition by admixing the aforementioned formulated toner composition mechanically blended at the same conditions as those in Example I, and with the same carrier. Thereafter, fusing evaluation by a standard image crease test is performed, and the minimum fix temperature of the toner is found to be F=−35° C. compared to an F=-35° C. for the same toner without D125 polystyrene. Adding D125 into the toner to increase jetting rate did not sacrifice the toner fusing performance.

EXAMPLE VI

A toner is formulated by melt mixing 91 percent by weight of the aforementioned extruded resin in Example I with 4 weight percent of polystyrene, D125 obtained from Hercules-Sanyo Inc., 5 percent by weight of REGAL 330® carbon black from Cabot Inc. in a Werner & Pfleiderer ZSK-28 twin screw extruder at the same melt mixing conditions as Example I. Subsequent to air drying, the resulting toner is pulverized and classified to form a toner with an average particle diameter of about 8.8 microns and a geometric size distribution (GSD) of about 1.35 measured by a Coulter Counter. Jetting rates are calculated from collection yields, and found to be 48 pounds/hour.

Subsequently, there is prepared a developer composition by admixing the aforementioned formulated toner composition mechanically blended at the same conditions as those in Example I and with the carrier of Example I. Thereafter, fusing evaluation by a standard image crease test is performed, and the minimum fix temperature of the toner was found to be F=−33° C.

EXAMPLE VII

A toner is formulated by melt mixing 88 percent by weight of the aforementioned extruded resin in Example I with 7 weight percent of polystyrene, D125 obtained from Hercules-Sanyo Inc., 5 percent by weight of REGAL 330 ® carbon black from Cabot Inc. in a Werner & Pfleiderer ZSK-28 twin screw extruder at the same melt mixing conditions as Example I. Subsequent to air drying, the resulting toner is pulverized and classified to form a toner with an average particle diameter of about 8.9 microns and a geometric size distribution (GSD) of about 1.35 measured by a Coulter Counter. Jetting rates are calculated from collection yields, and found to be 41 pounds/hour.

Subsequently, there is prepared a developer composition by admixing the aforementioned formulated toner composition mechanically blended at the same conditions as those in Example I and with the carrier of Example I. Thereafter, fusing evaluation by a standard image crease test is performed, and the minimum fix temperature of the toner is found to be F=−33° C.

EXAMPLE VIII

A toner is formulated by melt mixing 85 percent by weight of the aforementioned extruded resin in Example I with 10 weight percent of polystyrene, D125 obtained from Hercules-Sanyo Inc., 5 percent by weight of REGAL 330® carbon black from Cabot Inc. in a Werner & Pfleiderer ZSK-28 twin screw extruder at the same melt mixing conditions as Example I. Subsequent to air drying, the resulting toner is pulverized and classified to form a toner with an average particle diameter of about 8.8 microns and a geometric size distribution (GSD) of about 1.36 measured by a Coulter Counter. Jetting rates are calculated from collection yields, and found to be 64 pounds/hour.

Subsequently, there is prepared a developer composition by admixing the aforementioned formulated toner composition mechanically blended at the same conditions as those in Example I. Thereafter, fusing evaluation by a standard image crease test is performed, and the minimum fix temperature of the toner is found to be F=−34° C.

COMPARATIVE EXAMPLE IX

A toner is formulated by melt mixing 87 percent by weight of the aforementioned extruded resin in Example I with 5 percent by weight of REGAL 330® carbon black from Cabot Inc., 4 weight percent of propylene wax, VISCOL 660P obtained from Sanyo Chemicals, and 4 weight percent of the compatibilizer AX8840, a ethylene-glycidyl methacrylate copolymer obtained from Elf AtoChem in a Werner & Pfleiderer ZSK-28 twin screw extruder at the same melt mixing conditions as Example I. Subsequent to air drying, the resulting toner is pulverized and classified to form a toner with an average particle diameter of about 9.2 microns and a geometric size distribution (GSD) of about 1.37 measured by a Coulter Counter. Jetting rates are calculated from collection yields, and found to be 24 pounds/hour.

Subsequently, there is prepared a developer composition by admixing the aforementioned formulated toner composition mechanically blended at the same conditions as those in Example I, and with the carrier of Example I throughout. Thereafter, fusing evaluation by a standard image crease test is performed, and the minimum fix temperature of the toner is found to be F=−33° C.

The higher 64 jetting rate, compared to the lower 24 jetting rate, indicates that the jetting rate is 2.7 times faster, that is the energy required to jet is 2.7 times less, and the turn around time for the jetting process is 2.7 times faster.

COMPARATIVE EXAMPLE X

A toner is formulated by melt mixing 95 percent by weight of the aforementioned extruded resin in Example I with 5 percent by weight of REGAL 330® carbon black from Cabot Inc. in a Werner & Pfleiderer ZSK-28 twin screw extruder at the same melt mixing conditions as Example I. Subsequent to air drying, the resulting toner is pulverized and classified to form a toner with an average particle diameter of about 8.8 microns and a geometric size distribution (GSD) of about 1.39 measured by a Coulter Counter. Jetting rates are calculated from collection yields, and found to be 44 pounds/hour.

Subsequently, there is prepared a developer composition by admixing the aforementioned formulated toner composition mechanically blended at the same conditions as those in Example I. Thereafter, fusing evaluation by a standard image crease test is performed, and the minimum fix temperature of the toner is found to be F=−35° C.

Other embodiments and modifications of the present invention may occur to those skilled in the art subsequent to a review of the information presented herein; these embodiments, modifications, and equivalents thereof, are also included within the scope of this invention.

What is claimed is:

1. A process for the preparation of toner which comprises mixing with a first toner resin a second resin incompatible with said first resin thereof, and thereafter adding colorant, wax, compatibilizer, and optional charge additive.

2. A process in accordance with claim 1 wherein the toner jetting rate improved by from about 26 percent to about 44 percent as compared to a toner wherein said incompatible resin is absent and wherein said incompatible resin and said first resin form two separate phases.

3. A process in accordance with claim 1 wherein said incompatible resin is a linear or branched polymer forming small domains within said toner, and which domains possess an average volume domain diameter of from about 0.05 to about 2 microns, and preferably from about 0.1 to about 1 micron, said incompatible polymer domain being substantially uniformly distributed throughout said first and said second toner resins; wherein said incompatible resin is a styrene copolymer, a methacrylate copolymer, an olefinic homopolymer, an olefinic copolymer, or a polyimide.

4. A process in accordance with claim 1 wherein said incompatible resin is selected in an amount of from about 0.5 to about 15 weight percent based on the total amount of said first resin and said second incompatible resin.

5. A process in accordance with claim 1 wherein said incompatible resin is selected in an amount of from about 2 to about 10 weight percent based on the total amount of said first resin and said second incompatible resin.

6. A process in accordance with claim 1 wherein said incompatible resin is selected in an amount of from about 2.5, 4, 7, or 10 weight percent based on the total amount of said first resin and said second incompatible resin.

7. A process in accordance with claim 1 wherein the wax is of a low molecular weight of from about an average $M_w$ of from about 1,000 to about 20,000.

8. A process in accordance with claim 7 wherein the wax is propylene, polyethylene, or mixtures thereof.

9. A process in accordance with claim 1 wherein the colorant is carbon black.

10. A process in accordance with claim 1 wherein the compatibilizer is an ethylene-glycidyl methacrylate copolymer.

11. A process in accordance with claim 1 wherein the first resin is present in an amount of from about 75 to about 85 weight percent, the incompatible second resin is present in an amount of from about 2 to about 10 weight percent, the colorant is present in an amount of from about 5 to about 10 weight percent, the wax is present in an amount of from about 2 to about 7 weight percent, and the compatibilizer is present in an amount of from about 2 to about 7 weight percent.

12. A process in accordance with claim 1 wherein the first resin comprises linear portions and crosslinked portions, and said crosslinked portions consist essentially of high density crosslinked microgel particles.

13. A process in accordance with claim 12 wherein said microgel particles are present in an amount of from about 0.001 to about 50 percent by weight of said first toner resin.

14. A process in accordance with claim 12 wherein said microgel particles are present in an amount of from about 0.1 to about 40 percent by weight of said first toner resin.

15. A process in accordance with claim 12 wherein said microgel particles have no more than a single bridging molecule between crosslinked chains.

16. A process in accordance with claim 12 wherein said linear portions comprise a linear unsaturated polyester resin.

17. A process in accordance with claim 12 wherein said linear portions have a number average molecular weight ($M_n$) as measured by gel permeation chromatography in the range of from about 1,000 to about 20,000.

18. A process in accordance with claim 1 wherein said toner comprises at least one charge additive selected from the group consisting of alkyl pyridinium halides and distearyl dimethyl ammonium methyl sulfate.

19. A process for the preparation of toner which comprises mixing an incompatible first resin and a second resin, and thereafter adding colorant, wax, and compatibilizer.

20. A process in accordance with claim 19 wherein the colorant is a pigment.

21. A process in accordance with claim 1 wherein the incompatible second polymer is polystyrene.

22. A process in accordance with claim 21 wherein the first resin is an extruded polyester.

23. A toner obtained by the process of claim 1.

24. A process in accordance with claim 1 wherein said charge enhancing additive is present, and wherein said incompatible resin is immiscible with said first toner resin.

25. A process in accordance with claim 1 said wherein colorant is a pigment.

26. A process in accordance with claim 1 wherein said colorant is a dye.

27. A process in accordance with claim 1 wherein said first resin is a crosslinked unsaturated polyester, and said second ink compatible resin is a polystyrene.

* * * * *